US012778296B2

(12) United States Patent
Welhart

(10) Patent No.: US 12,778,296 B2
(45) Date of Patent: Nov. 3, 2026

(54) FURNISHINGS MOUNTING APPARATUS

(71) Applicant: DockMonster, Inc., Jacksonville, FL (US)

(72) Inventor: Kris Welhart, Jacksonville, FL (US)

(73) Assignee: DockMonster, Inc., Jacksonville, FL (US)

( * ) Notice: Subject to any disclaimer, the term of this patent is extended or adjusted under 35 U.S.C. 154(b) by 10 days.

(21) Appl. No.: 18/980,986

(22) Filed: Dec. 13, 2024

(65) Prior Publication Data

US 2026/0069035 A1 Mar. 12, 2026

Related U.S. Application Data

(63) Continuation of application No. 29/962,684, filed on Sep. 12, 2024.

(51) Int. Cl.
*A47B 91/08* (2006.01)

(52) U.S. Cl.
CPC ..... *A47B 91/08* (2013.01)

(58) Field of Classification Search
CPC ..... A47B 91/08; A47B 91/024; A47B 91/00; A47B 91/02; F16M 11/10; F16M 2200/08
USPC .... 248/188.8, 688, 188.1, 188.2, 188.4, 677
See application file for complete search history.

(56) References Cited

U.S. PATENT DOCUMENTS 5,037,232 A 8/1991 Pakdipanichpong
5,056,746 A 10/1991 Parsons et al.
5,332,182 A * 7/1994 Weisz ..... G01G 23/002 248/188.4
7,290,741 B1 * 11/2007 Cox ..... A47B 91/06 248/188.4
7,900,485 B2 * 3/2011 Lee ..... D06F 39/125 68/3 R
8,777,025 B1 * 7/2014 Buckleitner ..... D06F 57/12 211/205
9,010,888 B2 * 4/2015 Kim ..... A47B 91/14 312/351.3
D844,424 S 4/2019 MacDonald
(Continued)

OTHER PUBLICATIONS

TC Manufacturers' Select Silver Sequoia III Table Leg System for RV or Boat (27') TL4002C-27 (B07VSJX6R5), ITC Manufacturers' Select, First Available: Dec. 18, 2023. https://www.amazon.in/Manufacturers-Select-Sequoia-TL4002C-27-B07VSJX6R5/dp/B07VSJX6R5?th=1. Retrieved Mar. 24, 2025, 4 pages.

*Primary Examiner* — Terrell L Mckinnon
*Assistant Examiner* — Michael McDuffie
(74) *Attorney, Agent, or Firm* — Sheppard, Mullin, Richter & Hampton LLP

(57) ABSTRACT

In some implementations, a furnishing mounting device may include a base having a first mounting structure extending from a portion of the base, a first groove within the first mounting structure, and a first release structure disposed within the first mounting structure; a cover mounted to the base may include an opening, a second mounting structure extending from a portion of the cover, and a second release structure extending from the second mounting structure. In addition, the device may include a spring clip secured within the first groove and having wings extending into the first groove. The device may include an insert member of a geometry to fit within the opening of the cover and having a chamfered end and second groove around at least a portion of its outer periphery.

38 Claims, 7 Drawing Sheets

(56) References Cited

U.S. PATENT DOCUMENTS

| | | | | |
|---|---|---|---|---|
| 10,415,618 | B2 | 9/2019 | Kadosh | |
| D874,916 | S | 2/2020 | Wigboldy et al. | |
| D885,866 | S | 6/2020 | Chapman et al. | |
| D917,263 | S | 4/2021 | Kennedy | |
| 11,071,382 | B2 * | 7/2021 | Cole | A47B 91/005 |
| D991,772 | S | 7/2023 | Min et al. | |
| D1,000,934 | S | 10/2023 | Buttner et al. | |
| D1,024,048 | S | 4/2024 | Peters et al. | |
| D1,024,049 | S | 4/2024 | Peters et al. | |
| D1,075,738 | S | 5/2025 | Cooper | |
| D1,089,174 | S | 8/2025 | Ting et al. | |
| 12,398,575 | B2 * | 8/2025 | Ding | F16B 9/052 |
| D1,091,290 | S | 9/2025 | Lopez | |
| 2008/0116330 | A1 * | 5/2008 | Cotto | A47B 91/024 248/188.4 |
| 2010/0237205 | A1 * | 9/2010 | Hirsh | A47C 7/008 248/188.4 |
| 2016/0131300 | A1 * | 5/2016 | Cornelissen | A47J 43/0716 248/688 |
| 2022/0211171 | A1 | 7/2022 | Schneider et al. | |

* cited by examiner

FURNISHINGS MOUNTING APPARATUS

REFERENCE TO RELATED APPLICATIONS

The present application is a continuation of and claims priority to U.S. Design patent application Ser. No. 29/962,684, filed Sep. 12, 2024 and titled "FURNISHINGS MOUNTING APPARATUS," which is incorporated herein by reference in its entirety.

TECHNICAL FIELD

The present disclosure relates generally to furniture mounting, and in particular, some implementations may relate to docking structures to mount furniture.

DESCRIPTION OF RELATED ART

Furnishings, such as furniture, accessories and other implements, can traditionally be mounted to surfaces using brackets or furniture legs that are secured to the surface. Brackets can be secured using screws, nails, or other fasteners. Mounting furniture or other furnishings using brackets, while sturdy, can become problematic if furniture needs to be moved or rearranged. Similarly, if furniture legs are secured to the surface, it may be time consuming to detach the furniture or to take apart the furniture in order to successfully move it. Traditional systems are unable to provide both the security of fastening the furniture and ease in moving or rearranging the furniture items.

BRIEF SUMMARY OF THE DISCLOSURE

In accordance with some implementations herein, docking structure may include a cover plate mounted to the base plate, the cover plate having an opening, a second cylindrical structure and a top tab structure extending from the second cylindrical structure. The docking structure may also include a spring clip secured within the first groove of the base plate and having first and second wings extending into the first groove of the base plate. The docking structure may furthermore include a cylindrical insert having a chamfered end and second groove around at least a portion of an outer diameter of the cylindrical insert. The docking structure may be configured such that upon insertion into the opening of the cover plate, the chamfered end of the cylindrical insert spreads the spring clip, and upon further insertion the spring clip springs into a position at least partially within the second groove releasably engaging the cylindrical insert.

The described implementations may also include one or more of the following features. The docking structure wherein when the base plate is mounted to a docking surface and the cylindrical insert is mounted to a furnishing, further where engagement of the cylindrical insert by the spring clip secures the furnishing to the docking surface. The docking structure wherein the cover plate is rotatably mounted to the base plate, and further where rotation of the cover plate relative to the base plate causes the top tab structure to engage with the first wing of the spring clip, thereby spreading the spring clip open disengaging the cylindrical insert and allowing the cylindrical insert to be removed from the opening of the cover plate.

In accordance with various embodiments, where rotation of the cover plate relative to the base plate causes the base tab structure to engage with the second wing of the spring clip to prevent rotation of the spring clip within the first groove such that rotation of the top tab structure with the cover plate causes the first and second wings to spread apart relative to one another. In accordance with various embodiments, the base tab structure extends inward from an inner surface of the first cylindrical structure.

In various embodiments, the top tab structure extends downward from an edge of the second cylindrical structure. The second cylindrical structure may be configured to fit within the first cylindrical structure. The docking structure may include a ring disposed within the first cylindrical structure. The the cover plate and the base plate are keyed for alignment.

Further aspects may include a furnishing mounting system, which may include a base having a first mounting structure having an inner surface, the first mounting structure extending from a portion of the base, a first groove within the inner surface of the first mounting structure, and a first release structure disposed within the first mounting structure. The mounting system may also include a cover mounted to the base, the cover having an opening, a second mounting structure extending from a portion of the cover, and a second release structure extending from the second mounting structure. The mounting system may furthermore include a spring clip secured within the first groove of the base and having first and second wings extending into the first groove of the base. The mounting system may in addition include an insert member of a geometry to fit within the opening of the cover and having a chamfered end and second groove around at least a portion of an outer periphery of the insert member. The mounting system may moreover include where upon insertion into the opening of the cover, the chamfered end of the insert member separates ends of the spring clip, and upon further insertion the spring clip springs into a position at least partially within the second groove releasably engaging the insert member.

The described implementations may also include one or more of the following features. The base may be mounted to a docking surface and the insert member is mounted to a furnishing, and where engagement of the insert member by the spring clip secures the furnishing to the docking surface. The furnishing mounting cover may be rotatably mounted to the base, and further where rotation of the cover relative to the base causes the second release structure to engage with the first wing of the spring clip, thereby spreading the spring clip open disengaging the insert member and allowing the insert member to be removed from the opening of the cover. Rotation of the cover relative to the base may cause the first release structure to engage with the second wing of the spring clip to prevent rotation of the spring clip within the first groove such that rotation of the second release structure with the cover causes the first and second wings to spread apart relative to one another. The first release structure may extend inward from an inner surface of the first mounting structure and the second release structure may extend downward from an edge of the second mounting structure. The second mounting structure may be configured to fit within the first mounting structure. The cover and the base may be keyed for alignment.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1:
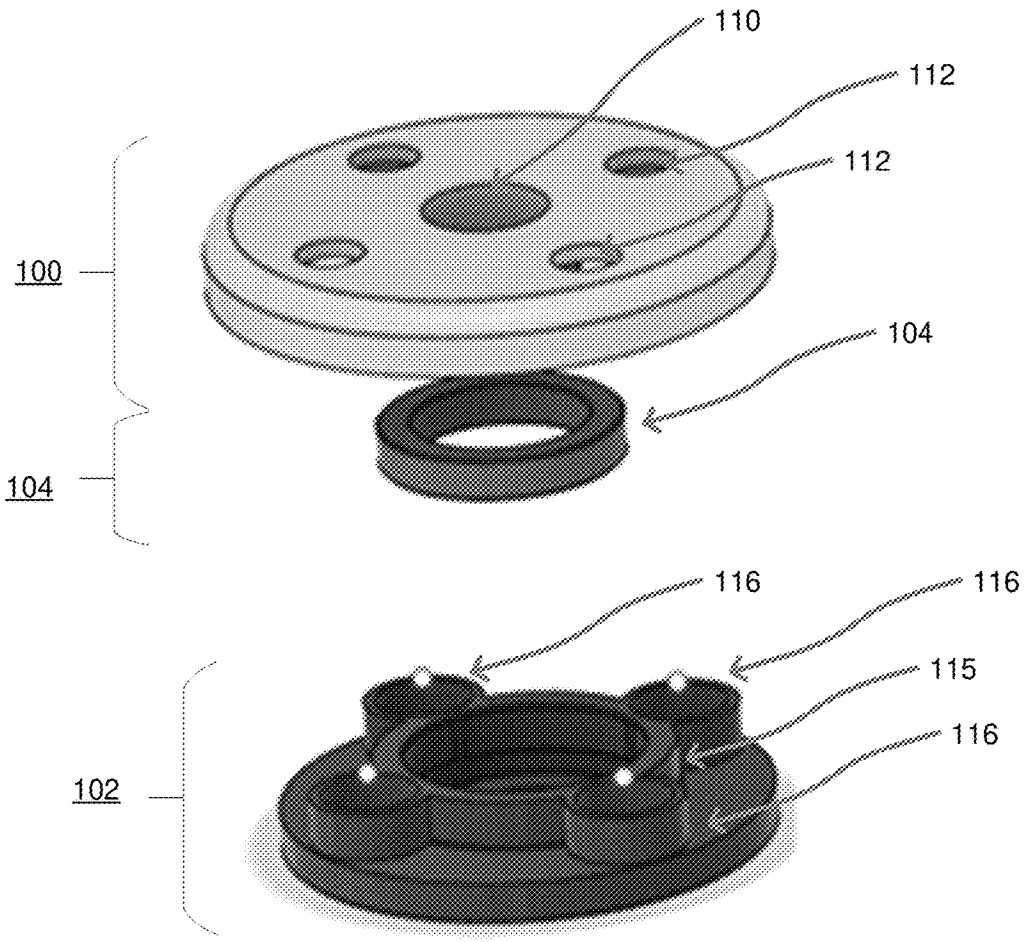
FIG. 1 illustrates an exploded view of a docking structure in accordance with one embodiment.

The figures are not exhaustive and do not limit the present disclosure to the precise form disclosed.

DETAILED DESCRIPTION

Embodiments of the systems and methods disclosed herein can provide a docking structure to mount furnishings using a spring clip mechanism. Here, furnishings can refer to couches, chairs, tables, umbrellas or umbrella bases, or any other furniture or accessory that connect to or rest on a docking surface such as, for example, a deck, dock, porch, patio, floor or other base. For ease of explanation, embodiments are described using an example of furniture as the furnishings, and furniture legs as the component of furniture by which the disclosed structure may secure the furniture in place. This explanation is made by way of example only and does not limit the claims in any way to this example embodiment.

An example docking structure may comprise a base plate, a cover plate, an insert, and a spring clip. The base plate can include a hollow cylindrical structure (e.g., at the center) and a groove or slot. A tab structure may be of a geometry such that it extends inward from the inner surface of the cylinder and upward from a base of the cylinder. The spring clip may comprise wings that fit at least partially within the groove of the cylinder such that the spring clip may remain within the base plate. The cover plate can snap or otherwise be fitted onto the base plate. The cover plate may include a cylinder extending downward from a top of the cover plate and may further include a tab that extends downward from a bottom edge of the cylinder. The cylinder of the cover plate may be dimensioned such that it fits within the cylinder of the base plate.

The insert (e.g., a furniture leg insert) can be installed on the bottom of the furniture leg by screwing it into the bottom of the furniture leg or otherwise fastening or attaching it to the leg or other component of the furnishing to be secured. The attachment may be by means of mechanical fasteners such as, for example, one or more screws or other threaded fasteners, bayonet mounts, clips, tabs or other mechanical fastening means; or by using chemical fasteners such as, for example, glues, epoxies, etc., or by a combination of the foregoing.

The insert may be configured to be inserted into the docking structure, and is further configured with a locking structure to engage with components of the base to lock the insert in place so that the furniture cannot easily move, be blown away, slide, etc. For example, the insert can comprise a chamfered bottom and a groove around its outer circumference, such that, when the insert is pushed into the docking structure, the chamfered bottom forces the spring clip to open allowing the insert to be pushed past it, and then the spring clip springs back into its resting state and engages the outer groove of the insert to hold the insert (and the attached furnishing) in place. The tabs extending from the cylinders on the cover plate and base plate may be used to open the spring clip to release the insert and allow the furnishing to be removed from the docking structure. The cover plate of the docking structure may be configured to be rotated, such that the tab of the cover plate pulls the spring clip open. The tab of the base may be positioned to prevent the spring clip from rotating around in the inner groove of the base when the cover plate is rotated so that the tab of the top clip can force the spring clip to open and disengage or release the insert.

FIG. 1 illustrates an exploded view of an example docking structure in accordance with one embodiment. As mentioned above, the docking structure can comprise a cover plate 100, a base plate 102, and may also include a center ring 104. Cover plate 100, base plate 102, and center ring 104 may be made of plastics (e.g., plastic, polycarbonate, polyvinyl chloride, Polyethylene Terephthalate (PET or PETE), Acrylonitrile Butadiene Styrene (ABS), Nylon (Polyamide), Polyoxymethylene (POM), Acrylic (Polymethyl Methacrylate-PMMA), and others), metals and alloys (e.g., metals and alloys such as stainless steel, aluminum, brass, and others), a combination of any of the foregoing, or any other material. Cover plate 100, base plate 102, and center ring 104 may all be made of the same material, or can be made of different materials from one another. Cover plate 100, base plate 102, and center ring 104 may each be cast, molded, 3D printed or otherwise fashioned. They may each be provided as a unitary structure or they may be formed of separate components.

Base plate 102 in this example includes a first mounting structure, which in this example is a hollow cylindrical structure 115 at the center and one or more openings 116 (also cylindrical in this example) surrounding the center structure. A release structure, which in this example is a tab structure 342 (see FIG. 3), can be included and dimensioned to extend inward from the inner surface of hollow cylindrical structure 115 and upward from a bottom section of hollow cylindrical structure 115. Tab structure 342 may be a protrusion, pin, insert, ledge, shelf or other type of offset surface (integrated or separate structure) that allows engagement with wings 256 of spring clip 255 as described below.

Figure 3:
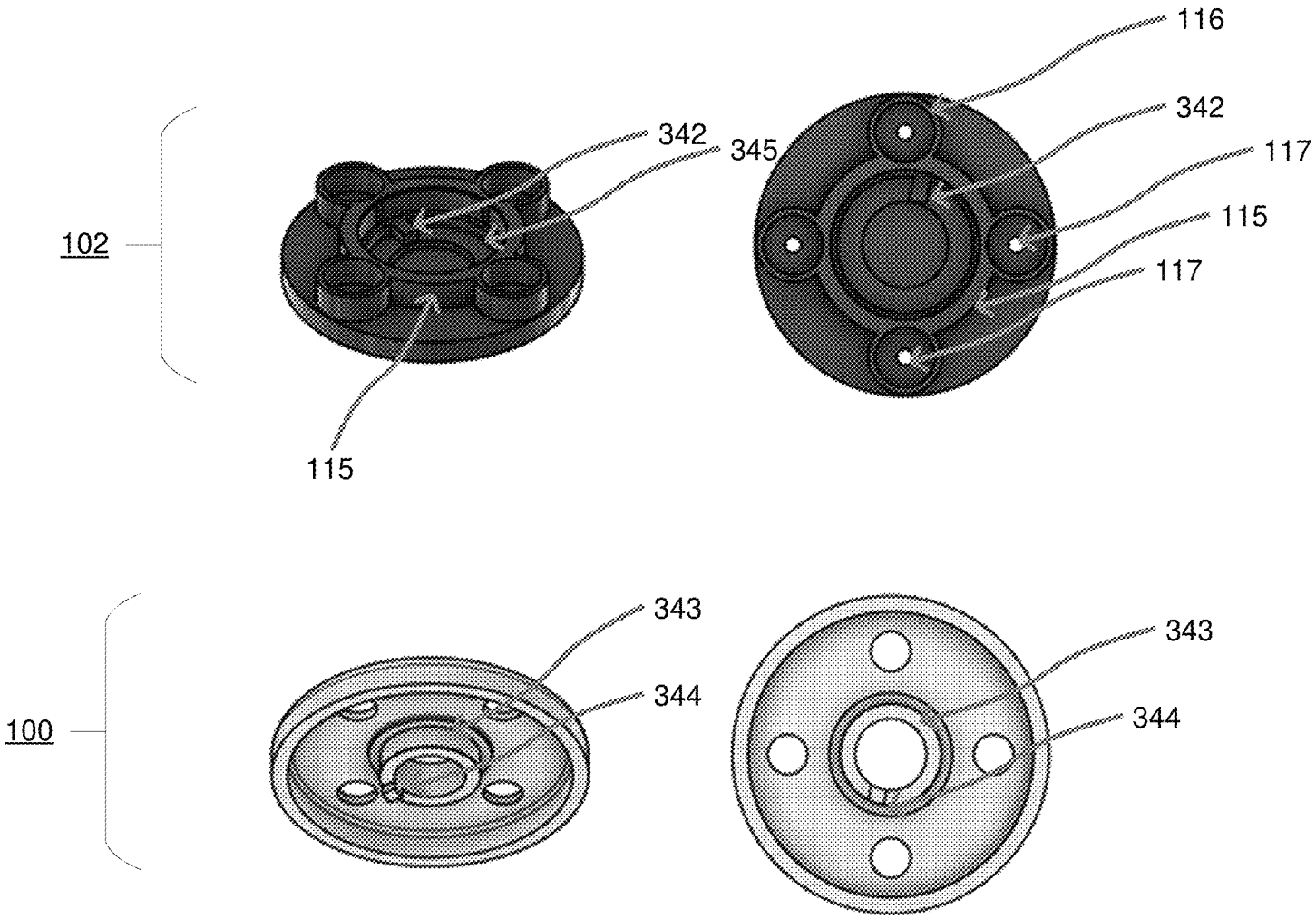
FIG. 3 illustrates bottom perspective views of a cover plate and base plate of a docking structure in accordance with one embodiment.

Cover plate 100 can also comprise a hole 110 at the center that forms an upper opening to a second mounting structure, which in this example is an inner hollow cylindrical structure 343 (FIG. 3). In this example, inner hollow cylindrical structure 343 of cover plate 100 is dimensioned to fit within hollow cylindrical structure 115 of base plate 102 upon assembly. Further in this example, inner hollow cylindrical structure 343 of cover plate 100 is dimensioned to fit within center ring 104, which is dimensioned to fit within hollow cylindrical structure 115 of base plate 102 upon assembly.

Cover plate 100 may also include a release structure, which in this example is a tab structure 344 that extends downward from the bottom edge of inner hollow cylindrical structure 343. Tab structure 344 on cover plate 100 can be used in conjunction with tab structure 342 on base plate 102 to release insert 106 from the assembly. Tab structure 344 may be a protrusion, pin, insert, ledge, shelf or other type of offset surface (integrated or separate structure) that allows engagement with wings 256 of spring clip 255 as described below. This is further described below with reference to FIG. 7 in accordance with one example.

Cover plate 100 and base plate 102 may be configured and dimensioned to be fixedly or removably locked together. These pieces may be fixedly or releasably mounted to one another via a friction fit, or by some other interlocking feature such as a lip, on the cylinder, tab locks, and so on. Center ring 104 is dimensioned to have an outer diameter that fits within hollow cylindrical structure 115 of base plate 102, and to have an inner diameter that accepts inner hollow cylindrical structure 343 of cover plate 100. In various embodiments, center ring 104 is dimensioned to provide a friction fit between inner hollow cylindrical structure 343 of cover plate 100 and hollow cylindrical structure 115 of base plate 102 to provide a mechanism to removably attach cover plate 100 to base plate 102. Center ring 104 may also help to retain spring clip 255 (FIG. 7) in place in the assembly. In various embodiments, the friction provided is sufficient to secure cover plate 100 to base plate 102 but not so great so as to prevent a user from rotating the plates in relation to one another for release of the spring clip (described below). In various embodiments cover plate 100 and base plate 102 may be keyed for alignment.

Figure 2:
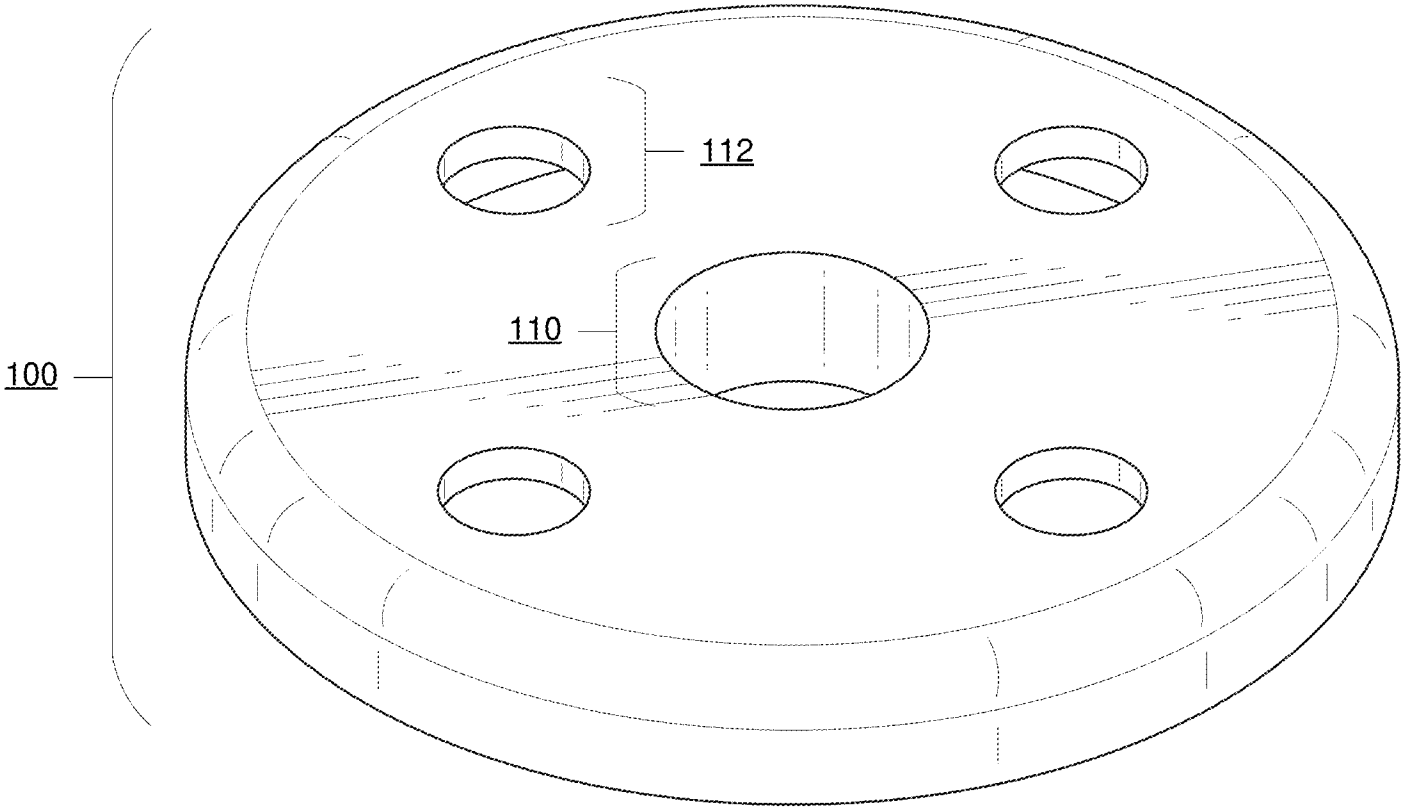
FIG. 2 illustrates a top perspective view of a cover plate of a docking structure in accordance with one embodiment.

FIG. 2 illustrates a top perspective view of the example cover plate 100 of FIG. 1. Referring now to FIG. 3, cover plate 100 in this example comprises a circular disk shape with a graduated or smooth curved edge. Cover plate 100 can comprise a center hole 110 that forms an opening of that aligns with the cylindrical structure of base plate 102. Center hole 110 and the inner diameter of inner hollow cylindrical structure 343 are dimensioned to receive an insert member (e.g., insert 106 described below).

FIG. 3 illustrates interior views of cover plate 100 and base plate 102 in accordance with the example of FIG. 1. Referring now to the example of FIG. 3, hollow cylindrical structure 115 of base plate 102 includes a groove 345 around all or part of the circumference of its inner surface. Groove 345 may be dimensioned to accept spring clip 255 (FIG. 7) so that spring clip 255 may rotate within the groove in the inner region of hollow cylindrical structure 115, but may be further dimensioned to prevent spring clip 255 from movement in the axial direction relative to hollow cylindrical structure 115.

This example includes four hollow perimeter cylinders 116 equally spaced about the perimeter of base plate 102. Other quantities of hollow perimeter cylinders 116 may be provided. In this example, each hollow perimeter cylinder 116 also includes an inner hole 117. Inner hole 117 is dimensioned to accept a screw, nail, rivet, or other fastening mechanism that can be used to secure base plate 102 to the dock, deck, patio, or other surface on which the furnishing is to be placed. For example, base plate 102 can be screwed in place using the four inner holes 117. Inner hole 117 may further be dimensioned to accept the fastening mechanism, but allowing a head of the fastening mechanism (e.g., a screw head, nail head, etc.) to hold base plate 102 in place such that washers may be included but are not necessary. In other embodiments, other fastening mechanism locations may be used to mount base plate 102 in place on the dock, deck, patio, or other surface on which the furnishing is to be placed. One other such example is via a hole at the center of base plate 102 (or holes at various locations of base plate 102).

Figure 4:
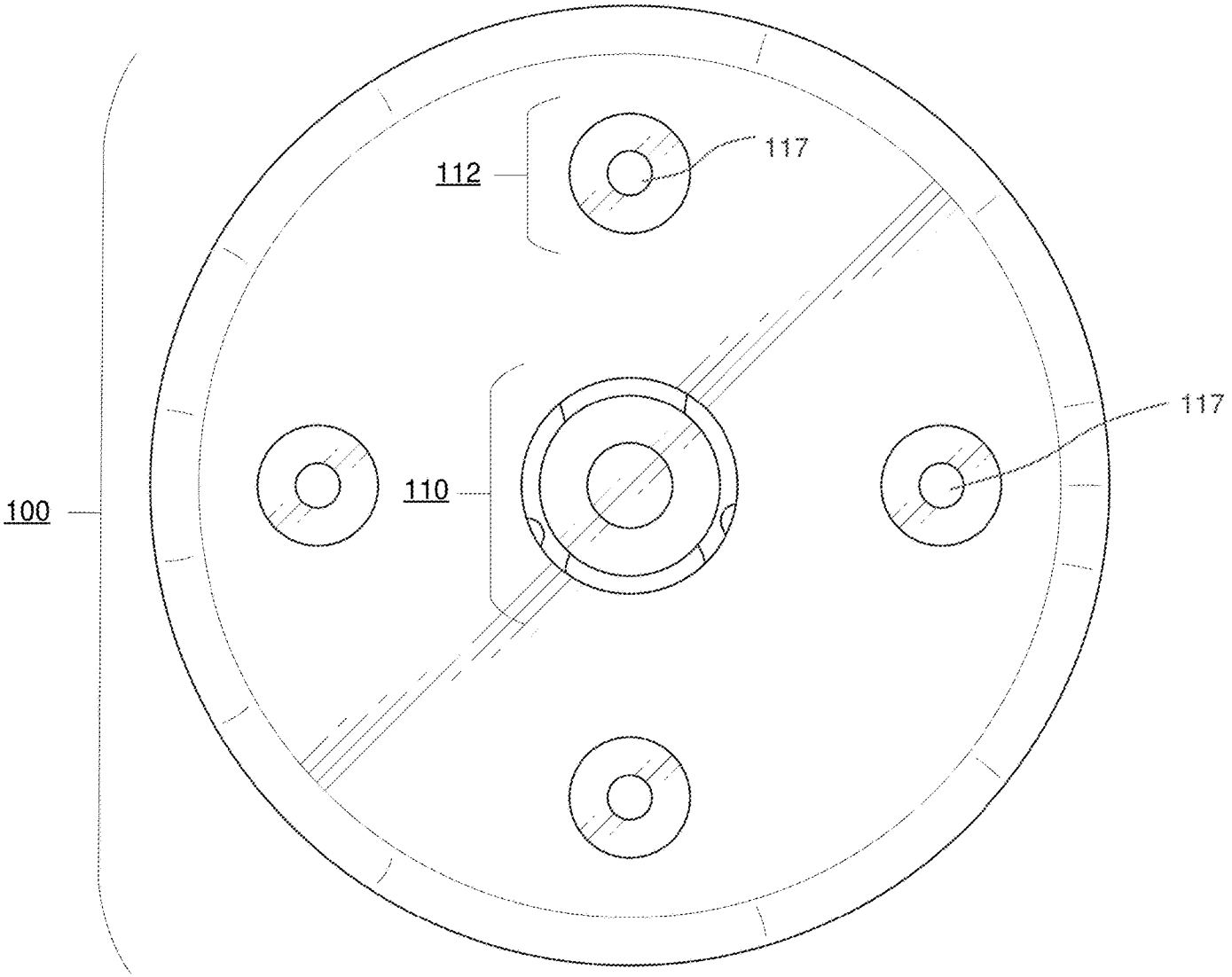
FIG. 4 illustrates a top view of a cover plate of a docking structure in accordance with one embodiment.

FIG. 4 illustrates a top view of the example cover plate 100 when connected to base plate 102. As illustrated in the example of FIG. 4, cover plate may be positioned such that holes 112 on cover plate 100 align with hollow perimeter cylinders 116 on base plate 102. Such alignment may be beneficial to allow access to the mounting screws without removing cover plate 100 from base plate 102. The assembly may be configured such that holes 112 on cover plate 100 align with hollow perimeter cylinders 116 on base plate 102 in a normally biased position such that cover plate 100 does not need to be rotated by the user for such alignment to occur. Alternatively, the assembly may be configured such that rotation of the cover plate is required to allow access to the screws on base plate 102 via holes 112 on cover plate 100.

Figure 5:
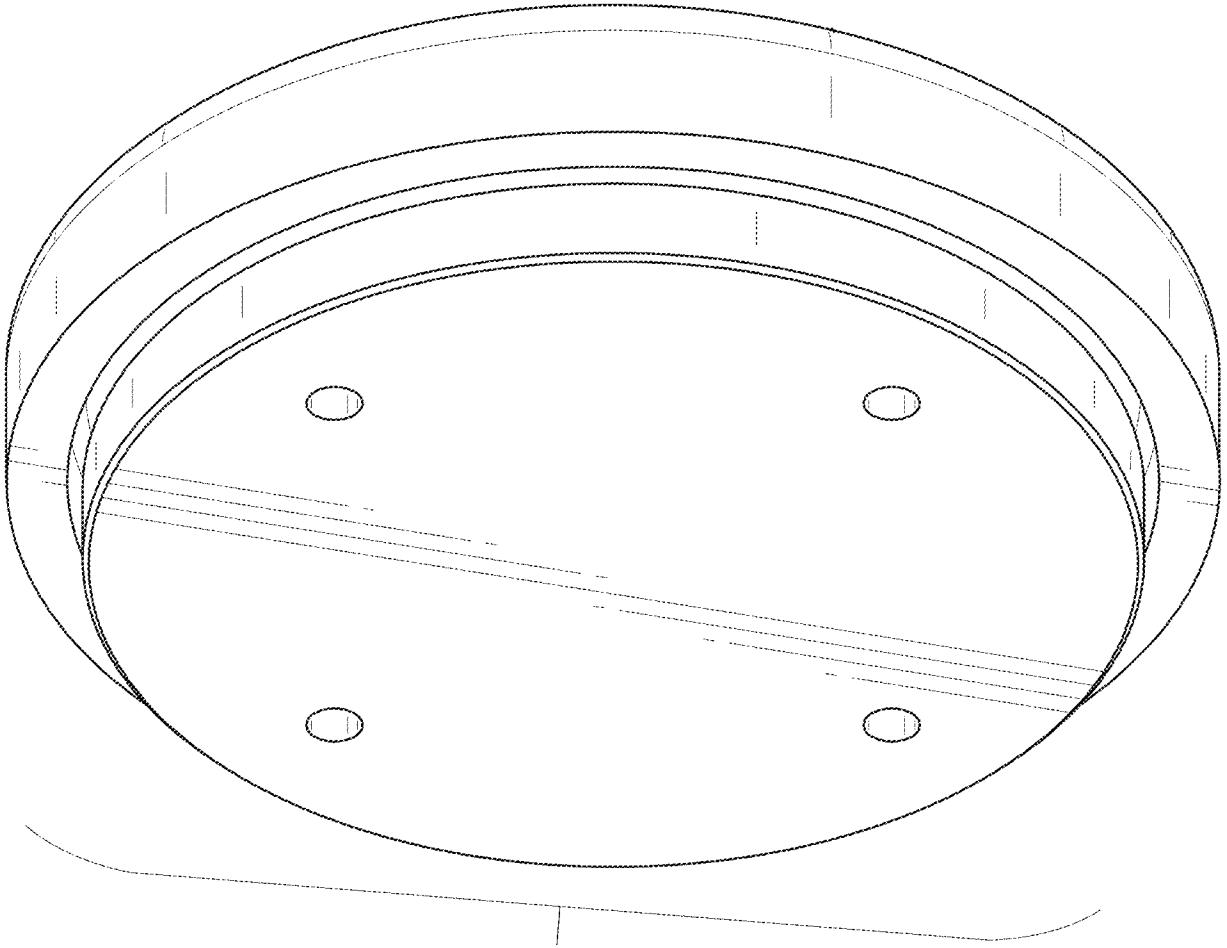
FIG. 5 illustrates a bottom perspective view of a base plate of a docking structure in accordance with one embodiment.
Figure 6:
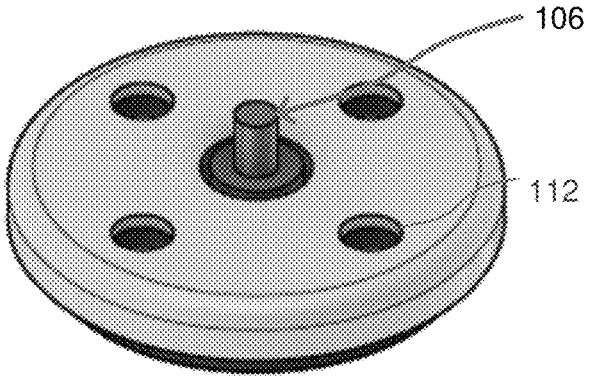
FIG. 6 illustrates a side view of a docking structure in accordance with one embodiment.
Figure 6:
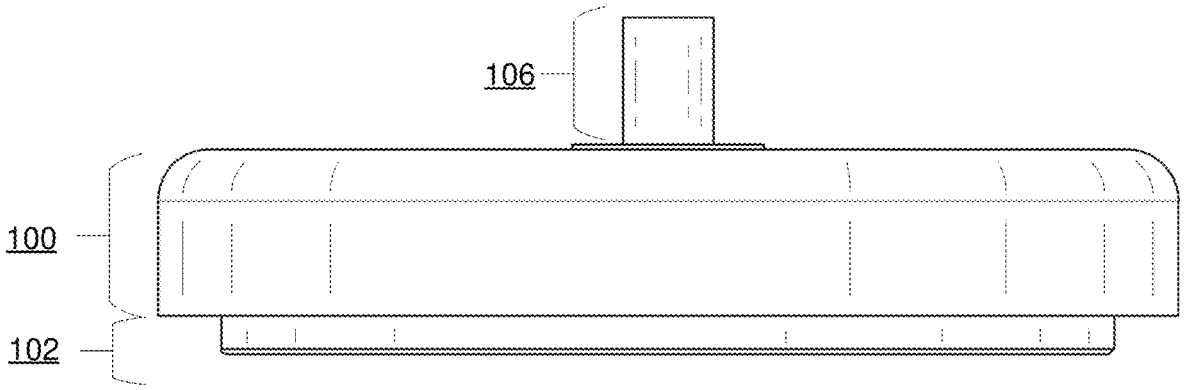

FIGS. 5 and 6 illustrate perspective views and a side view of the example docking structure when cover plate 100 and base plate 102 are connected. As illustrated in FIGS. 5 and 6, cover plate 100 can be dimensioned to extend downward over base plate 102, leaving a determined portion of base plate 102 exposed or visible from the side. Such dimensioning can be utilized to prevent cover plate 100 from scraping against the surface on which the assembly is mounted, such as during rotation operations of cover plate 100. This may be useful in a number of applications, including in situations where the surface on which the assembly is mounted is uneven.

As also illustrated in the example of FIG. 6, insert 106 is mounted in the assembly and extends from hole 110 at the top of the assembly such that it can be mounted to an element of the furnishing to be secured such as a furniture leg. In this example, insert 106 can be partially visible once inserted into cover plate 100.

The diameter of base plate 102 may be smaller than that of cover plate 100 to allow cover plate 100 to at least partially conceal faceplate 102 and its inner structures. In this example, the smooth surface and contours of cover plate 100 provide a clean and sleek look to the assembly. Although not illustrated, caps can be provided to snap or otherwise fit into holes 112 on cover plate 100 to provide for an even cleaner look and to help reduce the intrusion of moisture into the assembly.

Figure 7:
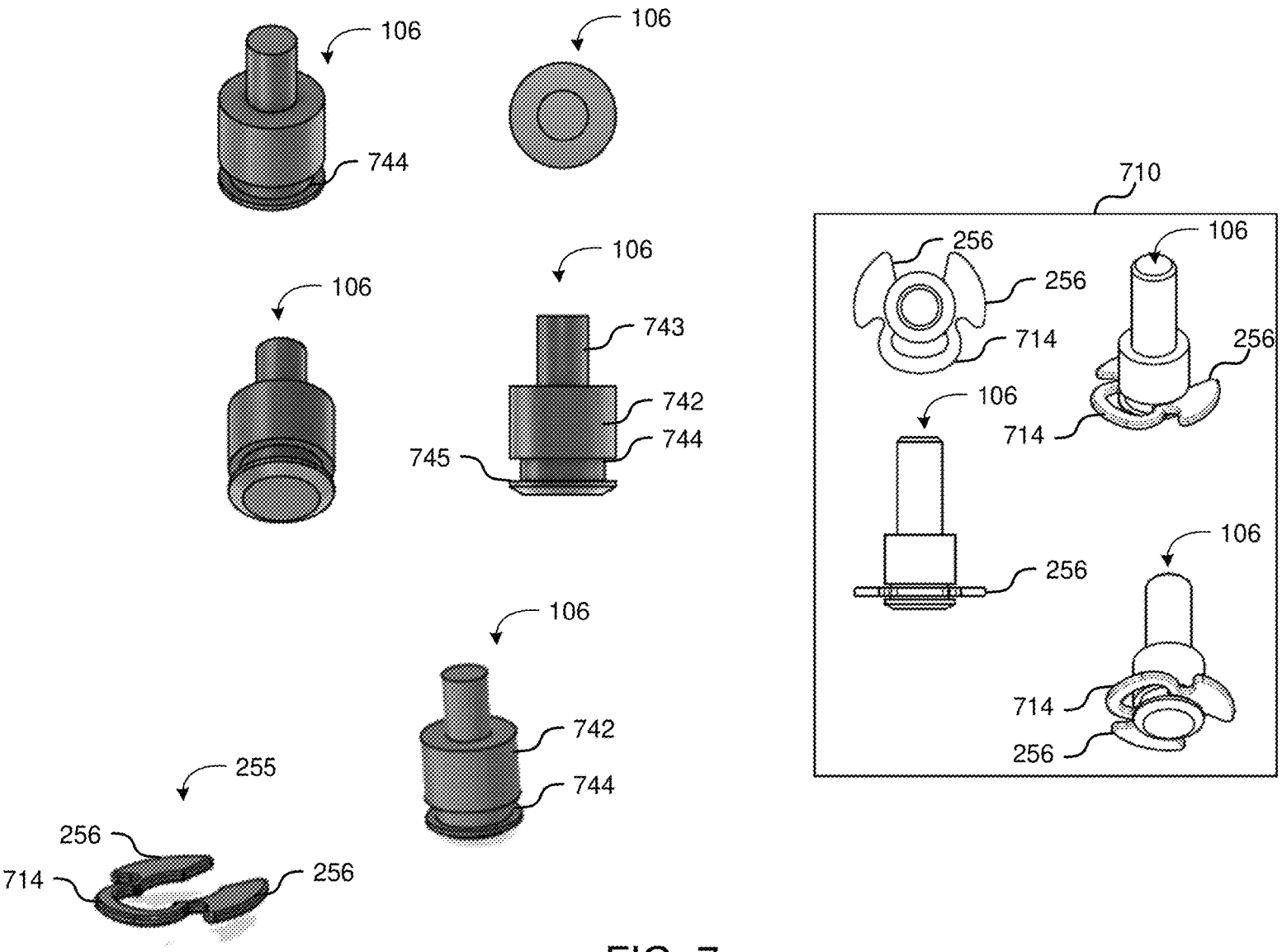
FIG. 7 illustrates multiple views of a furniture leg insert of a docking structure in accordance with one embodiment.

FIG. 7 further illustrates insert 106 and spring clip 255 in accordance with an example embodiment. Referring now to FIG. 7, insert 106 in this example is a cylindrical structure that includes a main body 742, a mounting structure extending from main body 742 and a chamfered section 745. Insert 106 further includes a groove 744 in this example. Spring clip 255 is dimensioned to have an inner diameter that fits around the diameter of groove 744 and to have a width that fits within the height of groove 744.

Spring clip 255 can be used to releasably engage the insert member. For example, upon assembly, spring clip 255 is secured within groove 345 of base plate 102. To secure the furnishing, insert 106 (attached to a portion of the furnishing such as, for example, a furniture leg) is pushed down into the assembly. Chamfered section 745 engages with spring clip 255 and separates ends of spring clip 255 such that spring clip 255 is spread open and insert 106 can be inserted into spring clip 255. Upon further insertion, spring clip 255 springs back to engage with groove 744 on insert 106. An example of this is shown in the views at 710, which illustrate spring clip 255 snapped into groove 744 of insert 106 such that an inner diameter of spring clip 255 at least partially surrounds and engaged with the outer surface of groove 744. In this example, wings 256 extend beyond the diameter of insert 106. In this example, spring arm 714 also extends beyond the diameter of insert 106 and extends into a portion of groove 345, further securing spring clip 255 into groove 345 of base plate 102. Because spring clip 255 is secured within groove 345 of base plate 102, and because spring clip 255 engages with groove 744 on insert 106, spring clip 255 effectively holds insert 106 within the assembly as shown in FIGS. 5 and 6. And by virtue of insert 106 being attached to a portion of the furnishing, the furnishing is also secured to the assembly. As noted above, in various embodiments center ring 104 may also help to hold spring clip 255 in place.

Although insert 106 is illustrated in this example as being cylindrical, in other embodiments, insert 106 may be of another geometry such as, for example, triangular or rectangular or otherwise. In such embodiments, the center hole and cylinder to receive insert 106 can be shaped accordingly to snugly receive insert 106.

As also illustrated in the example of FIG. 7, spring clip 255 further includes wings 256 which are extended portions of spring clip 255. Wings 256 are dimensioned to extend at least partially into the inner opening of hollow cylindrical structure 115 of base plate 102. In this example, wings 256 are dimensioned to be engaged by tab structure 342 of base plate 102 and tab structure 344 of cover plate 100. Particularly, when cover plate 100 is rotated, tab structure 344 of cover plate 100 engages with one of the wings 256, pressing it outward to open the inner diameter of spring clip 255. To prevent spring clip 255 from simply rotating within groove 345 and not opening, tab structure 342 of base plate 102 engages the other of the wings 256 to prevented from rotating further. The rotational movement of the two tabs away from each other (in this example tab 344 rotating with cover plate 100 and tab structure 342 remaining stationary with base plate 102) forces the spring clip open. Sufficient rotation open spring clip 255 wide enough such that it clears groove 744 on insert 106 such that the insert can be removed (and the attached furnishing moved). In other embodiments, spring clip 255 may be configured with holes (or slots) of a geometry to engage with the tab structures (which may have different shapes to correspond to and engage with the holes or slots) to control release of the insert 106 upon rotation of base plate 102 relative to cover plate 100.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A docking structure comprising:

a base plate comprising a first cylindrical structure, a first groove within an inner surface of the first cylindrical structure and a base tab structure disposed within the first cylindrical structure that extends inward from the inner surface of the first cylindrical structure;

a cover plate mounted to the base plate, the cover plate comprising an opening, a second cylindrical structure and a top tab structure extending from the second cylindrical structure;

a spring clip secured within the first groove of the base plate and comprising first and second wings extending into the first groove of the base plate; and a cylindrical insert comprising a chamfered end and second groove around at least a portion of an outer diameter of the cylindrical insert;

wherein upon insertion into the opening of the cover plate, the chamfered end of the cylindrical insert spreads the spring clip, and upon further insertion the spring clip springs into a position at least partially within the second groove releasably engaging the cylindrical insert.

2. The docking structure of claim 1, wherein when the base plate is mounted to a docking surface and the cylindrical insert is mounted to a furnishing, further wherein engagement of the cylindrical insert by the spring clip secures the furnishing to the docking surface.

3. The docking structure of claim 1, wherein the cover plate is rotatably mounted to the base plate, and further wherein rotation of the cover plate relative to the base plate causes the top tab structure to engage with the first wing of the spring clip, thereby spreading the spring clip open disengaging the cylindrical insert and allowing the cylindrical insert to be removed from the opening of the cover plate.

4. The docking structure of claim 3, wherein rotation of the cover plate relative to the base plate causes the base tab structure to engage with the second wing of the spring clip to prevent rotation of the spring clip within the first groove such that rotation of the top tab structure with the cover plate causes the first and second wings to spread apart relative to one another.

5. The docking structure of claim 1, wherein the top tab structure extends downward from an edge of the second cylindrical structure.

6. The docking structure of claim 1, wherein the second cylindrical structure is configured to fit within the first cylindrical structure.

7. The docking structure of claim 1, further comprising a ring disposed within the first cylindrical structure.

8. The docking structure of claim 1, wherein the cover plate and the base plate are keyed for alignment.

9. A furnishing mounting system, comprising:

a body comprising:

a base comprising a first mounting structure comprising an inner surface, the first mounting structure extending from a portion of the base, a first groove within the inner surface of the first mounting structure, and a first release structure disposed within the first mounting structure that extends inward from the inner surface of the first mounting structure;

a cover mounted to the base, the cover comprising an opening, a second mounting structure extending from a portion of the cover, and a second release structure extending from the second mounting structure;

a spring clip secured within the first groove of the base and comprising first and second wings extending into the first groove of the base; and an insert member of a geometry to fit within the opening of the cover and comprising a chamfered end and second groove around at least a portion of an outer periphery of the insert member;

wherein upon insertion into the opening of the cover, the chamfered end of the insert member separates ends of the spring clip, and upon further insertion the spring clip springs into a position at least partially within the second groove releasably engaging the insert member.

10. The furnishing mounting system of claim 9, wherein when the base is mounted to a docking surface and the insert member is mounted to a furnishing, and wherein engagement of the insert member by the spring clip secures the furnishing to the docking surface.

11. The furnishing mounting system of claim 9, wherein the cover is rotatably mounted to the base, and further wherein rotation of the cover relative to the base causes the second release structure to engage with the first wing of the spring clip, thereby spreading the spring clip open disengaging the insert member and allowing the insert member to be removed from the opening of the cover.

12. The furnishing mounting system of claim 11, wherein rotation of the cover relative to the base causes the first release structure to engage with the second wing of the spring clip to prevent rotation of the spring clip within the first groove such that rotation of the second release structure with the cover causes the first and second wings to spread apart relative to one another.

13. The furnishing mounting system of claim 9, wherein the second release structure extends downward from an edge of the second mounting structure.

14. The furnishing mounting system of claim 9, wherein the second mounting structure is configured to fit within the first mounting structure.

15. The furnishing mounting system of claim 9, wherein the cover and the base are keyed for alignment.

16. A docking structure comprising:

a base plate comprising a first cylindrical structure, a first groove within an inner surface of the first cylindrical structure and a base tab structure disposed within the first cylindrical structure;

a cover plate mounted to the base plate, the cover plate comprising an opening, a second cylindrical structure and a top tab structure extending downward from an edge of the second cylindrical structure;

a spring clip secured within the first groove of the base plate and comprising first and second wings extending into the first groove of the base plate; and a cylindrical insert comprising a chamfered end and second groove around at least a portion of an outer diameter of the cylindrical insert;

wherein upon insertion into the opening of the cover plate, the chamfered end of the cylindrical insert spreads the spring clip, and upon further insertion the spring clip springs into a position at least partially within the second groove releasably engaging the cylindrical insert.

17. The docking structure of claim 16, wherein when the base plate is mounted to a docking surface and the cylindrical insert is mounted to a furnishing, further wherein engagement of the cylindrical insert by the spring clip secures the furnishing to the docking surface.

18. The docking structure of claim 16, wherein the cover plate is rotatably mounted to the base plate, and further wherein rotation of the cover plate relative to the base plate causes the top tab structure to engage with the first wing of the spring clip, thereby spreading the spring clip open disengaging the cylindrical insert and allowing the cylindrical insert to be removed from the opening of the cover plate.

19. The docking structure of claim 18, wherein rotation of the cover plate relative to the base plate causes the base tab structure to engage with the second wing of the spring clip to prevent rotation of the spring clip within the first groove such that rotation of the top tab structure with the cover plate causes the first and second wings to spread apart relative to one another.

20. The docking structure of claim 16, wherein the base tab structure extends inward from the inner surface of the first cylindrical structure.

21. The docking structure of claim 16, wherein the second cylindrical structure is configured to fit within the first cylindrical structure.

22. The docking structure of claim 16, further comprising a ring disposed within the first cylindrical structure.

23. The docking structure of claim 16, wherein the cover plate and the base plate are keyed for alignment.

24. A furnishing mounting system, comprising:

a body comprising:

a base comprising a first mounting structure comprising an inner surface, the first mounting structure extending from a portion of the base, a first groove within the inner surface of the first mounting structure, and a first release structure disposed within the first mounting structure;

a cover mounted to the base, the cover comprising an opening, a second mounting structure extending from a portion of the cover, and a second release structure extending downward from an edge of the second mounting structure;

a spring clip secured within the first groove of the base and comprising first and second wings extending into the first groove of the base; and an insert member of a geometry to fit within the opening of the cover and comprising a chamfered end and second groove around at least a portion of an outer periphery of the insert member;

wherein upon insertion into the opening of the cover, the chamfered end of the insert member separates ends of the spring clip, and upon further insertion the spring clip springs into a position at least partially within the second groove releasably engaging the insert member.

25. The furnishing mounting system of claim 24, wherein when the base is mounted to a docking surface and the insert member is mounted to a furnishing, and wherein engagement of the insert member by the spring clip secures the furnishing to the docking surface.

26. The furnishing mounting system of claim 24, wherein the cover is rotatably mounted to the base, and further wherein rotation of the cover relative to the base causes the second release structure to engage with the first wing of the spring clip, thereby spreading the spring clip open disengaging the insert member and allowing the insert member to be removed from the opening of the cover.

27. The furnishing mounting system of claim 26, wherein rotation of the cover relative to the base causes the first release structure to engage with the second wing of the spring clip to prevent rotation of the spring clip within the first groove such that rotation of the second release structure with the cover causes the first and second wings to spread apart relative to one another.

28. The furnishing mounting system of claim 26, wherein the first release structure extends inward from the inner surface of the first mounting structure.

29. The furnishing mounting system of claim 26, wherein the second mounting structure is configured to fit within the first mounting structure.

30. The furnishing mounting system of claim 26, wherein the cover and the base are keyed for alignment.

31. A docking structure comprising:

a base plate comprising a first cylindrical structure, a first groove within an inner surface of the first cylindrical structure and a base tab structure disposed within the first cylindrical structure;

a ring disposed within the first cylindrical structure;

a cover plate mounted to the base plate, the cover plate comprising an opening, a second cylindrical structure and a top tab structure extending from the second cylindrical structure;

a spring clip secured within the first groove of the base plate and comprising first and second wings extending into the first groove of the base plate; and a cylindrical insert comprising a chamfered end and second groove around at least a portion of an outer diameter of the cylindrical insert;

wherein upon insertion into the opening of the cover plate, the chamfered end of the cylindrical insert spreads the spring clip, and upon further insertion the spring clip springs into a position at least partially within the second groove releasably engaging the cylindrical insert.

32. The docking structure of claim 31, wherein when the base plate is mounted to a docking surface and the cylindrical insert is mounted to a furnishing, further wherein engagement of the cylindrical insert by the spring clip secures the furnishing to the docking surface.

33. The docking structure of claim 31, wherein the cover plate is rotatably mounted to the base plate, and further wherein rotation of the cover plate relative to the base plate causes the top tab structure to engage with the first wing of the spring clip, thereby spreading the spring clip open disengaging the cylindrical insert and allowing the cylindrical insert to be removed from the opening of the cover plate.

34. The docking structure of claim 33, wherein rotation of the cover plate relative to the base plate causes the base tab structure to engage with the second wing of the spring clip to prevent rotation of the spring clip within the first groove such that rotation of the top tab structure with the cover plate causes the first and second wings to spread apart relative to one another.

35. The docking structure of claim 31, wherein the base tab structure extends inward from the inner surface of the first cylindrical structure.

36. The docking structure of claim 31, wherein the top tab structure extends downward from an edge of the second cylindrical structure.

37. The docking structure of claim 31, wherein the second cylindrical structure is configured to fit within the first cylindrical structure.

38. The docking structure of claim 31, wherein the cover plate and the base plate are keyed for alignment.

* * * * *